US006379019B1

(12) United States Patent
Lin

(10) Patent No.: US 6,379,019 B1
(45) Date of Patent: Apr. 30, 2002

(54) LIGHTING STRUCTURE OF A SOCKET WRENCH

(76) Inventor: Chang Ming Lin, No. 331, Chang Chung St., Chiu Te Village, Wu Jih Hsirng, Taichung County (TW)

( * ) Notice: Subject to any disclaimer, the term of this patent is extended or adjusted under 35 U.S.C. 154(b) by 56 days.

(21) Appl. No.: 09/655,053

(22) Filed: Sep. 5, 2000

(51) Int. Cl.[7] ..... B25B 23/18; F21L 4/04

(52) U.S. Cl. ..... 362/119; 362/186; 362/197; 362/448

(58) Field of Search ..... 362/109, 119, 362/120, 186, 197, 437, 448

(56) References Cited

U.S. PATENT DOCUMENTS 4,364,104 A * 12/1982 Holahan et al. ..... 362/109
5,951,142 A * 9/1999 Wang et al. ..... 362/119
6,089,729 A * 7/2000 Chang ..... 362/120
6,186,638 B1 * 2/2001 Chang ..... 362/119
6,224,229 B1 * 5/2001 Lin ..... 362/119
6,238,058 B1 * 5/2001 Lin ..... 362/119
6,260,979 B1 * 7/2001 Lin ..... 362/119
6,283,607 B1 * 9/2001 Lin ..... 362/119

* cited by examiner

*Primary Examiner*—Alan Cariaso
(74) *Attorney, Agent, or Firm*—Harrison & Egbert

(57) ABSTRACT

A lighting structure of a socket wrench including a rotary seat which is fastened a housing seat of a handle body of the socket wrench. The rotary seat has a rotary shaft which is pivotally disposed in two pivoting slots of the housing seat and is fastened at both ends to a rotary knob. The rotary seat is fastened to a light-emitting element and a light focusing shield and is provided with two elastic bonding wires connecting the light-emitting element and a battery set disposed in a plug hole of the handle body of the socket wrench. The light-emitting element is adjusted by the rotary knob to emit light at a desired angle. The housing seat is provided with a transparent protective plate to shield the light-emitting element.

3 Claims, 9 Drawing Sheets

LIGHTING STRUCTURE OF A SOCKET WRENCH

BACKGROUND OF THE INVENTION

1. Field of the Invention

The present invention relates generally to a socket wrench, and more particularly to a lighting structure of the socket wrench.

2. Description of Related Art

As shown in FIGS. 1 and 2, a prior art socket wrench 10 comprises a handle 12 which is provided at one end with an opening 13 in which the free end of the socket wrench 10 is received. The handle 12 is provided at the other end with a threaded portion 15, a shoulder 16, and a plug hole 14 in which an insulated plug 17 is held. The insulated plug 17 has a conductive piece 18. In addition to the insulated plug 17, a battery set 19, and a switching element 20 are held in the plug hole 14. The switching element 20 has a protruded shoulder 21, a press button 22, and a connection spring 23. A cap 24 having a receiving hole 25 is used to position the switching element 20. The handle 12 is provided with a receiving cell 30 having a pivoting slot 31 which is in communication with the plug hole 14. The pivoting slot 31 has a guide slot 32 extending therefrom. A rotary member 33 with a shaft rod 34 is pivoted to the pivoting slot 31. The rotary member 33 is provided in the midsegment thereof with a light bulb port 35 for holding a light-emitting element 36 which has two pins 37 extending toward the rotary member 33 to be connected with two conductive pieces 38. The conductive piece 18 of the insulated plug 17 is provided with two extension bodies 39 extending into the receiving cell 30.

Such a prior art structure as described above is defective in design because the circuit connections of the pins 37 of the light-emitting element 36 and the conductive pieces 38, as well as the conductive piece 38 and the extension bodies 39 are susceptible to disconnection caused by an external force impacting on the housing base 40. In addition, the light-emitting element 36 is devoid of a light focusing means for enhancing the lighting effect. The light-emitting element 36 juts out of the rotary member 33 and is therefore vulnerable to damage.

BRIEF SUMMARY OF THE INVENTION

The primary objective of the present invention is to provide a socket wrench with a lighting structure which is free of the deficiencies of the prior art lighting structure described above.

In keeping with the principle of the present invention, the foregoing objective of the present invention is attained by a light structure comprising a rotary seat having a rotary shaft which is fastened to a rotary knob. The rotary seat is fastened to a light-emitting element and a light-focusing shield. The light-emitting element is connected with a battery set.

The foregoing objective, features, and functions of the present invention will be more readily understood upon a thoughtful deliberation of the following detailed description of the present invention with reference to the accompanying drawings.

DETAILED DESCRIPTION OF THE INVENTION

Figure 1:
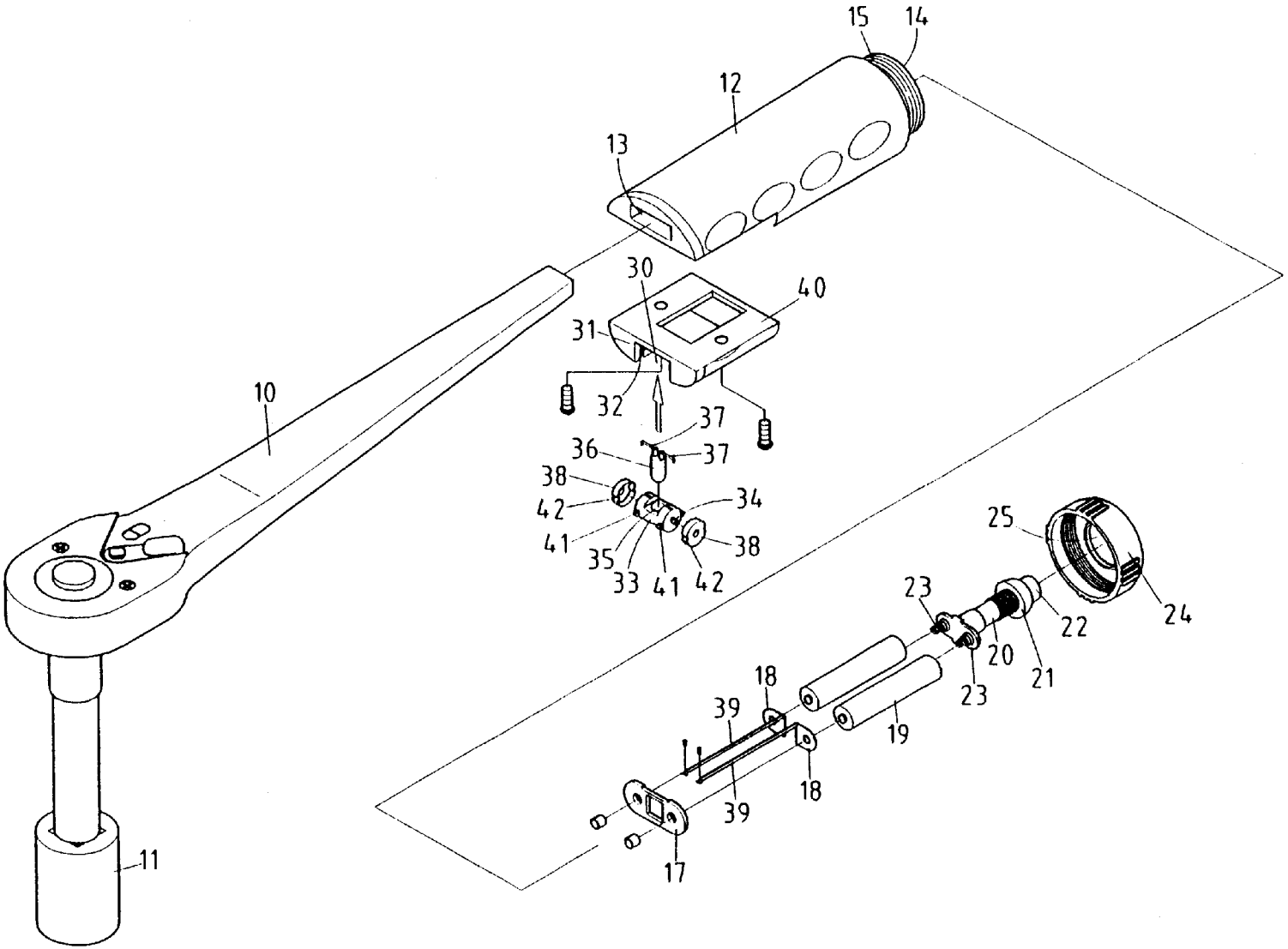
FIG. 1 PRIOR ART
FIG. 1 shows an exploded view of the prior art.
Figure 2:
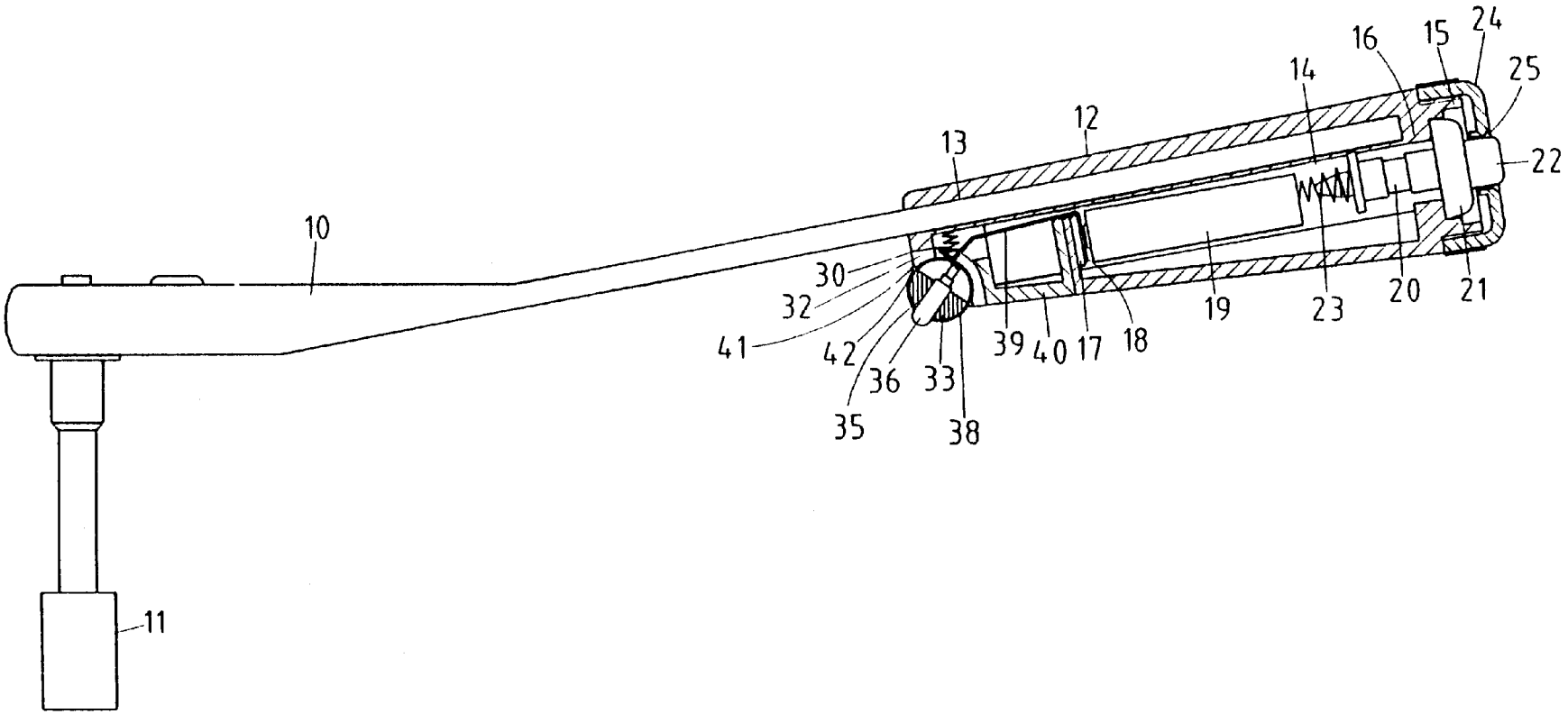
FIG. 2 PRIOR ART
FIG. 2 shows a longitudinal sectional view of the prior art.
Figure 3:
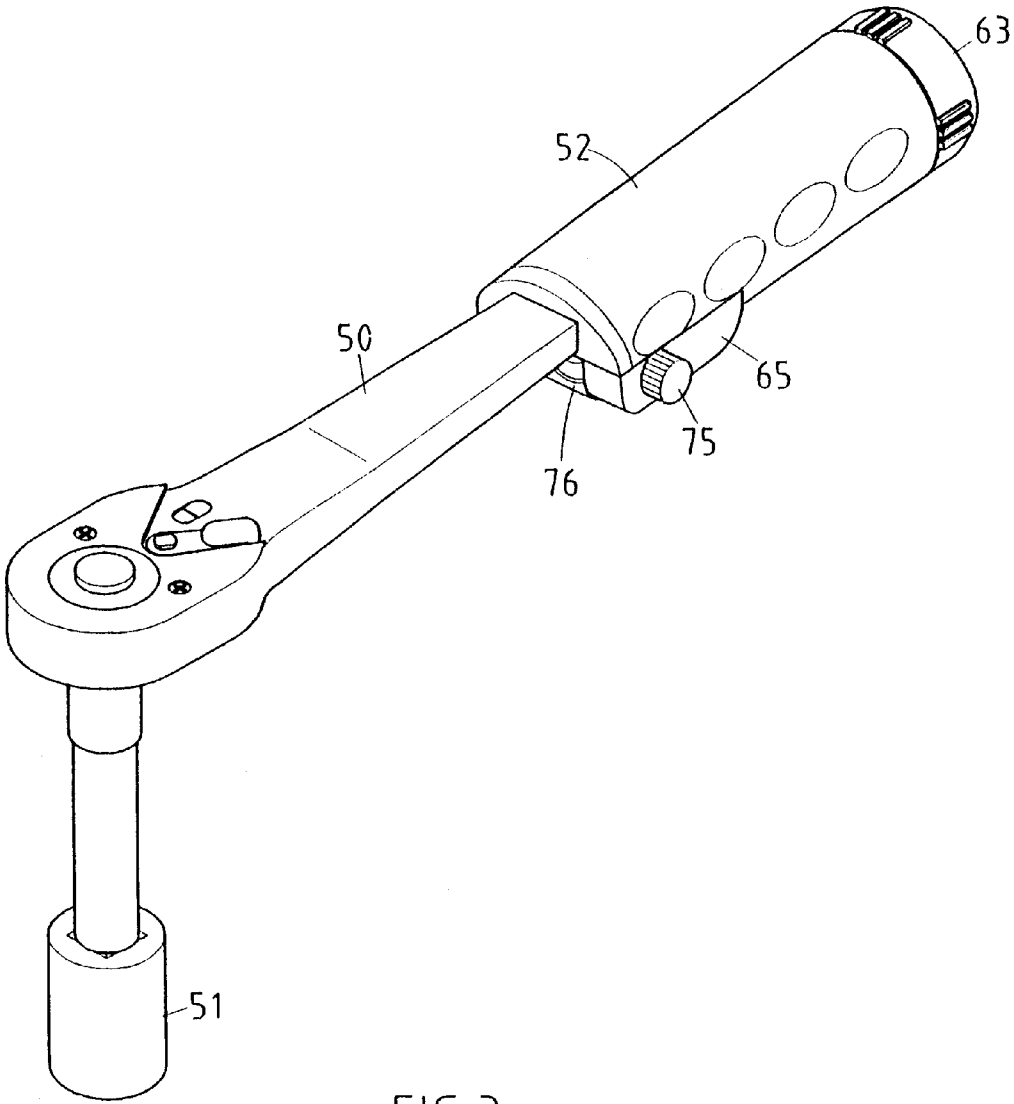
FIG. 3 shows a perspective view of the present invention.
Figure 4:
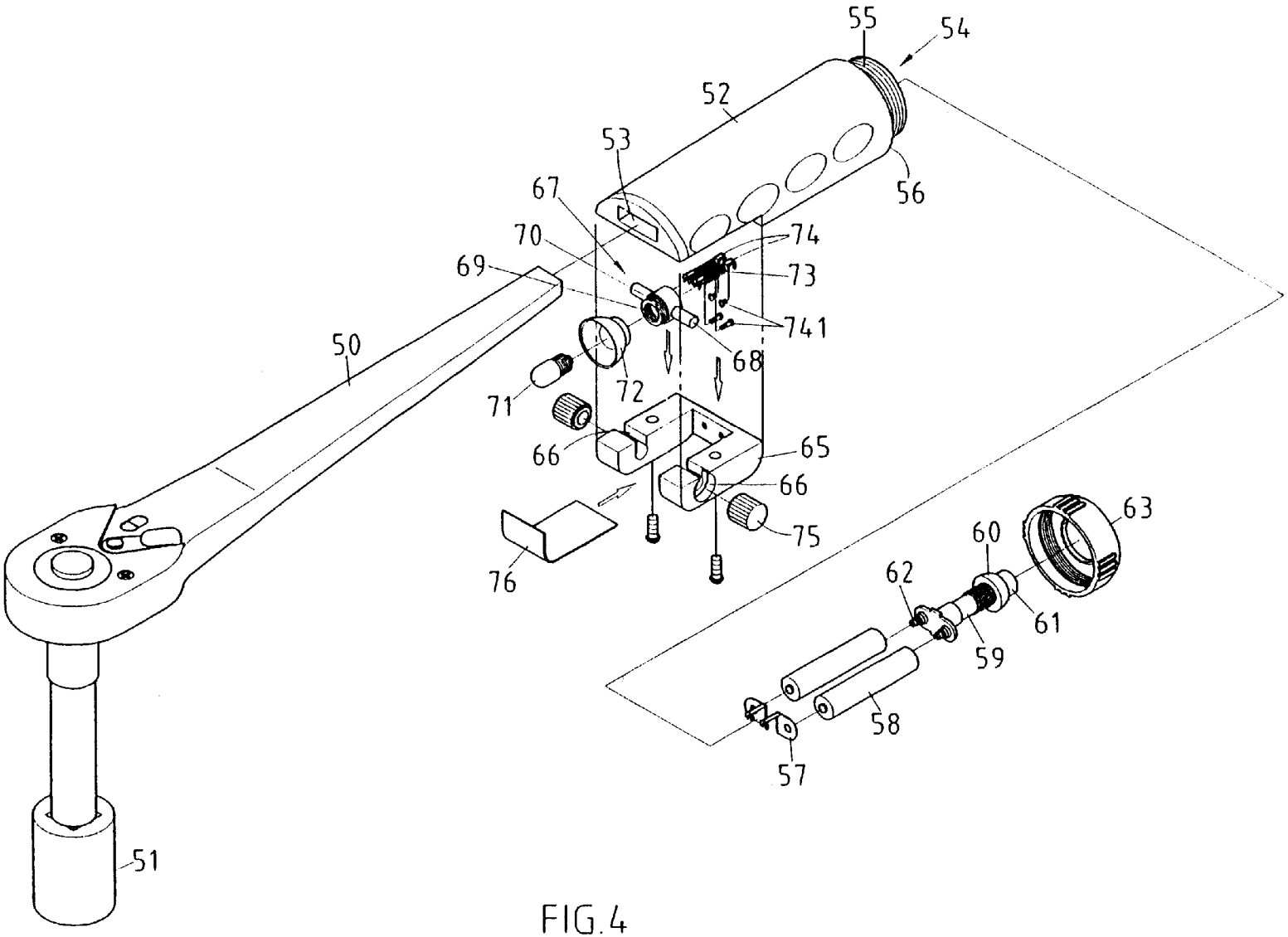
FIG. 4 shows an exploded view of the present invention.
Figure 5:
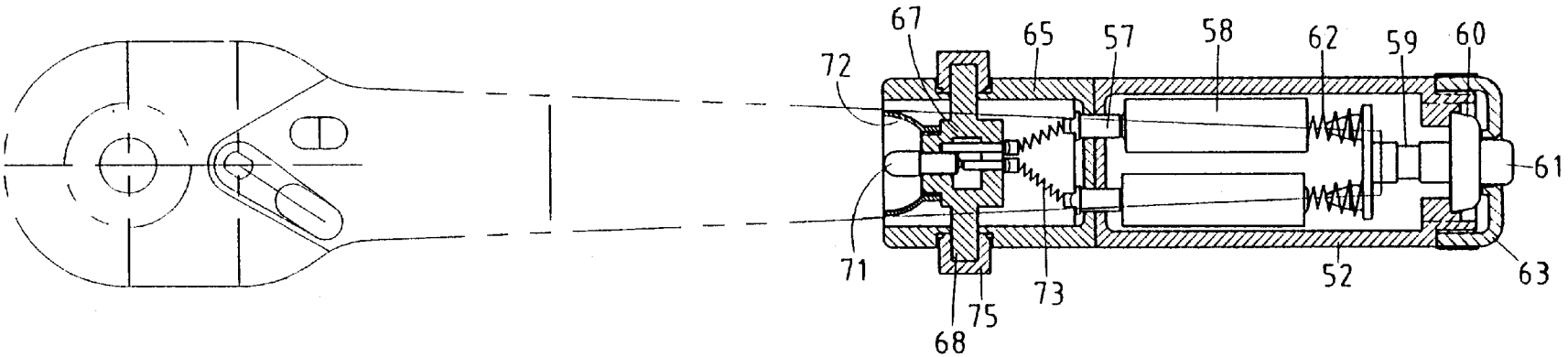
FIG. 5 shows a longitudinal sectional view of the present invention.
Figure 6:
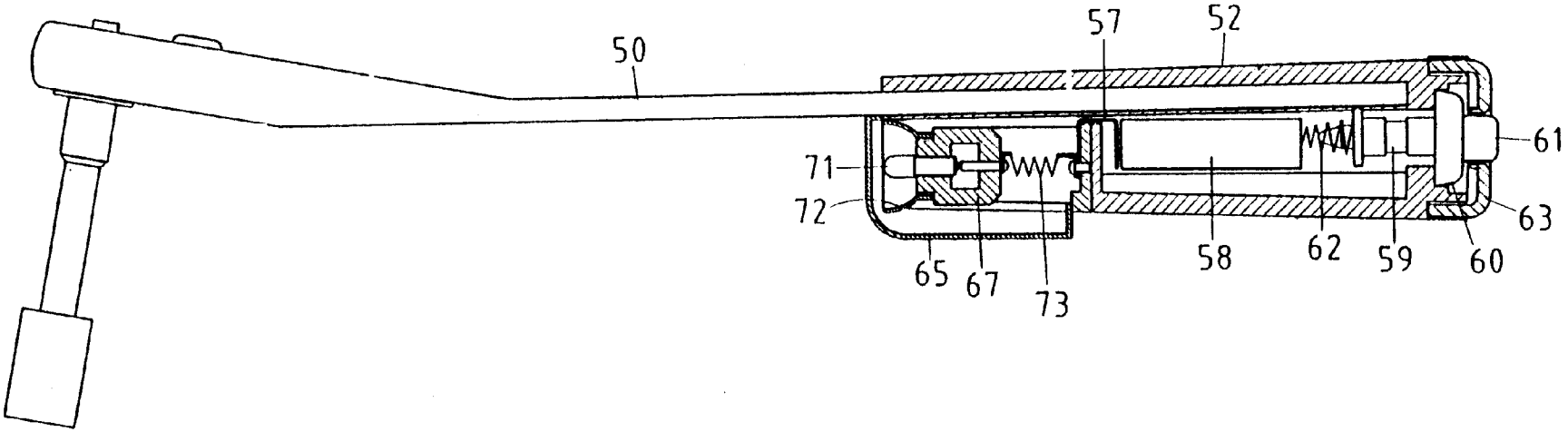
FIG. 6 shows another longitudinal sectional view of the present invention.
Figure 7:
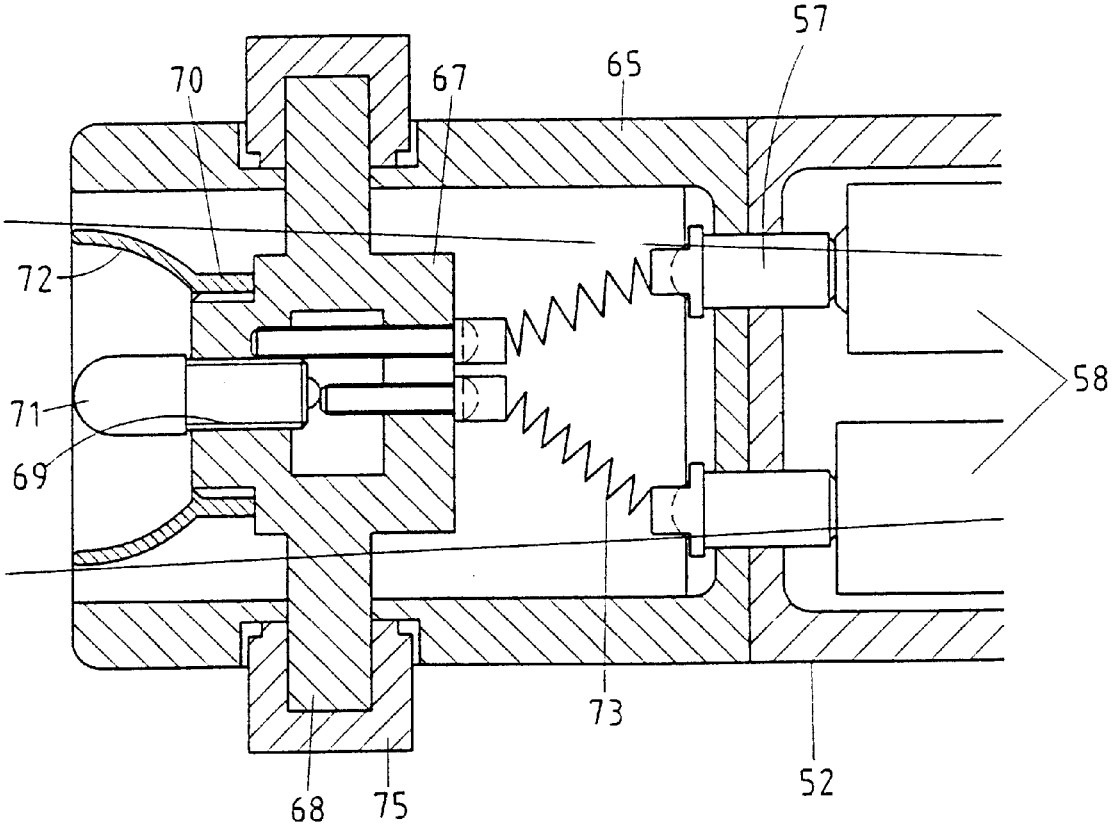
FIG. 7 shows a partial sectional view of the present invention.

As shown in FIGS. 3–8, a wrench 50 has a handle body 52 which is provided at one end with a mounting port 53. The wrench 50 has a socket 51. The handle body 52 is provided at another end with a threaded portion 55, a shoulder 56, and a plug hole 54. The plug hole 54 receives a conductive piece 57, a battery set 58, and a switch element 59 having a protruded shoulder 60, a press button 61, and a connection point spring 62. A cap 63 is engaged with the threaded portion 55 and is provided with a receiving space 64. The handle body 52 is further provided at one end thereof with a housing seat 65 having two pivoting slots 66 opposite in location to each other.

Figure 8:
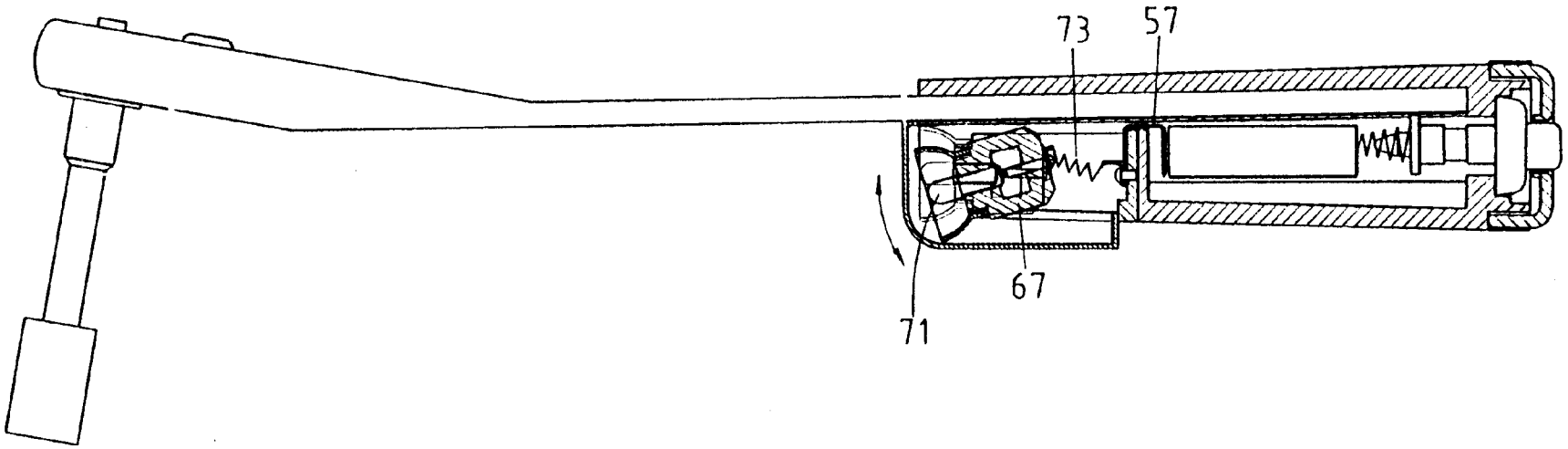
FIG. 8 shows a schematic view of the present invention in action.

The present invention is characterized by a rotary seat 67 having a rotary shaft 68 which is pivotally disposed in the pivoting slots 66 and is fastened at both ends to a rotary knob 75. The rotary seat 67 is provided with inner threads 69 and outer threads 70 for fastening a light-emitting element 71 and a light-focusing shield 72. The rotary seat 67 is further provided with two elastic bonding wires 73 which are connected with the light-emitting element 71 and the battery set 58. The housing seat 65 is provided at the bottom with a transparent protective plate 76 for shielding the light-emitting element 71. The lighting angle of the light-emitting element 71 is adjusted by the rotary knob 75, as shown in FIG. 8.

The elastic bonding wires 73 are provided at both ends with a terminal 74, which is connected with the conductive piece 57 of the rotary seat 67 by a plurality of screws 741.

Figure 9:
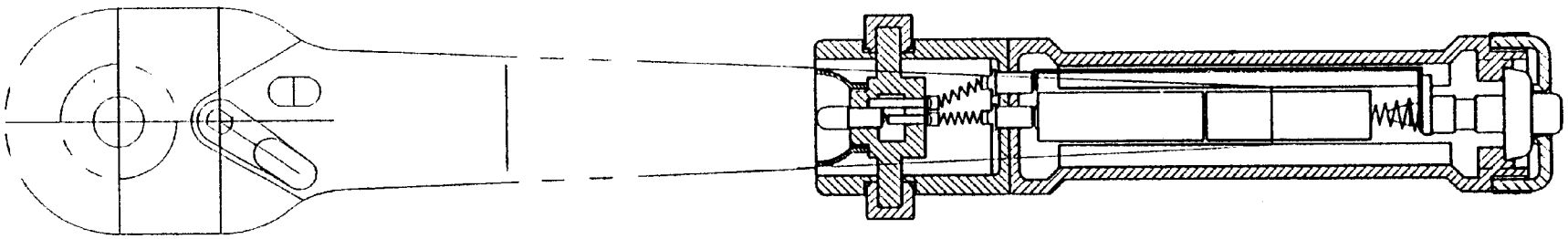
FIG. 9 shows a schematic view of another embodiment of the present invention.

As shown in FIG. 9, the battery set 58 of the present invention is serially arranged.

The light-emitting element 71 and the light-forcing shield 72 are fastened to the rotary seat 67 by means of threads. In light of this, the terminals of the elastic bonding wires 73 remain securely fastened to the conductive pieces 57 and the rotary seat 67 at such time when the light-emitting element 71 is adjusted by the rotary knob 75. The light emitted by the light-emitting element 71 is focused by the light focusing shield 72 so as to enhance the brightness. The light-emitting element 71 is well protected by the transparent protective plate 76.

I claim:

1. A lighting structure of a socket wrench, being mounted in an underside of a mounting port of one end of a handle body of the socket wrench, said handle body of the socket wrench comprising at another end a threaded portion, a shoulder, and a plug hole in which a conductive piece, a battery set, and a switch element are disposed, said threaded portion being engaged with a cap, said handle body further comprising at one end thereof a housing seat having two pivoting slots for mounting pivotally a rotary seat; wherein said rotary seat comprises a rotary shaft pivotally disposed in said pivoting slots of said housing seat such that said rotary shaft is fastened at both ends to a rotary knob, said rotary seat being provided with inner threads and outer threads for fastening a light-emitting element and a light focusing shield of said lighting structure, said rotary seat further comprising two elastic bonding wires connecting said light-emitting element and said battery set, said housing seat provided at a bottom with a transparent protective plate for shielding said light-emitting element, wherein said rotary knobs are used to adjust said light-emitting element to enable said light-emitting element to emit light at a desired angle.

2. The lighting structure as defined in claim 1, wherein said elastic bonding wires comprise at both ends a terminal wherein said terminal is connected with said conductive piece of said rotary seat by a plurality of screws.

3. The lighting structure as defined in claim 1, wherein said battery set is serially arranged.

* * * * *